US010882069B2

(12) United States Patent
Coe

(10) Patent No.: US 10,882,069 B2
(45) **Date of Patent: *Jan. 5, 2021**

(54) STORAGE CONTAINER FOR TUBE VISCOUS CONSTRUCTION MATERIAL

(71) Applicant: Craig M. Coe, Sagamore Beach, MA (US)

(72) Inventor: Craig M. Coe, Sagamore Beach, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/442,524

(22) Filed: Jun. 16, 2019

(65) Prior Publication Data

US 2019/0299245 A1 Oct. 3, 2019

Related U.S. Application Data

(63) Continuation of application No. 15/845,525, filed on Dec. 18, 2017, now Pat. No. 10,357,797, which is a (Continued)

(51) Int. Cl.
*B05C 17/03* (2006.01)
*B05C 17/005* (2006.01)

(Continued)

(52) U.S. Cl.
CPC ..... *B05C 17/0316* (2013.01); *B05C 17/0052* (2013.01); *B05C 17/00516* (2013.01);

(Continued)

(58) Field of Classification Search
CPC ..... B65D 35/44; B65D 41/023; B65D 85/08; B65D 51/00; B65D 77/0486; B25H 3/00;

(Continued)

(56) References Cited

U.S. PATENT DOCUMENTS 1,999,598 A * 4/1935 Levine ..... B65D 85/84 222/183
2,893,613 A * 7/1959 Davis ..... B65D 47/122 222/566

(Continued)

FOREIGN PATENT DOCUMENTS

DE 3815641 A1 11/1989
EP 1247746 A1 10/2002

(Continued)

OTHER PUBLICATIONS

Notification Concerning Transmittal of International Preliminary Report on Patentability (Chapter I of the Patent Cooperation Treaty) for PCT/US2018/065138, dated Jul. 2, 2020, 10 pages, the International Bureau of WIPO, Geneva, Switzerland.

(Continued)

*Primary Examiner* — Patrick M. Buechner
*Assistant Examiner* — Michael J. Melaragno
(74) *Attorney, Agent, or Firm* — Rauschenbach Patent Law Group, LLC; Kurt Rauschenbach

(57) ABSTRACT

A storage container for a cylindrical tube of viscous construction material includes a body dimensioned to receive a cylindrical tube of viscous construction material. A nozzle enclosure is attached to a top end of the body and is dimensioned to receive a nozzle of a cylindrical tube of viscous construction material. A plug is positioned in the nozzle enclosure and dimensioned to fit into an inner diameter of the nozzle of the cylindrical tube of viscous construction material. A gasket is positioned between the body and the nozzle that substantially prevents air in the body from entering into the nozzle enclosure. A base seals the cylindrical tube of viscous construction material in the body.

22 Claims, 9 Drawing Sheets

Related U.S. Application Data continuation-in-part of application No. 15/667,883, filed on Aug. 3, 2017, now Pat. No. 10,351,307.

(60) Provisional application No. 62/374,086, filed on Aug. 12, 2016.

(51) Int. Cl.
*B65D 77/04* (2006.01)
*B05C 17/01* (2006.01)
*B65D 35/28* (2006.01)
*B67D 1/00* (2006.01)

(52) U.S. Cl.
CPC .... *B05C 17/00583* (2013.01); *B05C 17/0146* (2013.01); *B65D 77/0486* (2013.01); *B65D 35/28* (2013.01); *B67D 1/0001* (2013.01)

(58) Field of Classification Search
CPC ..... B05C 17/00516; B05C 17/0052; B05C 17/00583; B05C 17/0146
USPC ..... 222/129, 130, 131, 153.1, 386.5; 220/582, 4.21, 4.24; 206/277, 384
See application file for complete search history.

(56) References Cited

U.S. PATENT DOCUMENTS 2,898,019 A * 8/1959 Williams ..... B65D 47/18 222/551
3,231,156 A * 1/1966 Schultz ..... A61M 3/00 222/92
3,275,179 A * 9/1966 Lux ..... B29C 65/06 220/4.21
3,286,934 A * 11/1966 Schneller ..... B05B 11/045 239/327
3,487,979 A * 1/1970 Hartley ..... B65D 83/386 222/183
3,731,848 A * 5/1973 Nakanishi ..... B65D 47/12 222/129
3,930,599 A * 1/1976 Brothers ..... B65D 43/0212 222/143
3,985,268 A * 10/1976 Wood ..... B05C 17/00583 222/108
4,154,366 A 5/1979 Acres
4,210,253 A * 7/1980 Rosier ..... B65D 21/086 220/8
D258,051 S * 1/1981 Bakus ..... D9/445
4,422,788 A * 12/1983 Braithwaite ..... B05C 17/0316 222/1
4,676,657 A * 6/1987 Botrie ..... B01F 5/0615 222/129
4,735,509 A * 4/1988 Rausch ..... B01F 11/0054 222/129
4,821,897 A * 4/1989 Weiler ..... B29C 49/20 215/251
4,957,223 A * 9/1990 Beilush ..... B05C 17/00583 222/326
5,154,327 A * 10/1992 Long ..... B05C 17/00516 220/375
5,295,601 A * 3/1994 Bostelman ..... B65D 35/44 215/306
5,301,839 A * 4/1994 Eierle ..... B05C 17/00576 222/105
5,303,852 A * 4/1994 Yamawaki ..... B65D 83/0055 222/209
5,312,018 A * 5/1994 Evezich ..... B65D 83/0055 222/105
5,678,729 A * 10/1997 Raymond ..... B65D 1/023 215/230
5,740,792 A * 4/1998 Ashley ..... A61M 15/0065 128/203.15
5,749,502 A * 5/1998 Hinds ..... B05B 9/0822 222/386.5
5,960,998 A * 10/1999 Brown ..... B05B 11/0005 222/131
6,145,685 A * 11/2000 Dick ..... B65D 21/0228 215/10
6,364,163 B1 * 4/2002 Mueller ..... B05B 11/048 222/105
6,481,597 B1 * 11/2002 Cermak, III ..... B05C 17/00503 215/355
6,578,573 B2 * 6/2003 Koch ..... A61M 16/12 128/200.14
6,691,900 B1 * 2/2004 Cermak, III ..... B05C 17/00503 222/552
6,832,797 B1 * 12/2004 Gassel ..... A47F 7/0028 211/70.6
7,308,993 B2 * 12/2007 Mineau ..... B65D 83/203 222/182
7,410,080 B2 * 8/2008 Good ..... A45F 5/02 224/251
8,342,351 B2 * 1/2013 Hobbs, Sr. ..... B65D 41/023 220/212.5
8,424,726 B2 * 4/2013 McClurg ..... B05C 17/0052 222/151
8,627,975 B1 * 1/2014 Whitbeck ..... B65D 35/32 220/254.1
9,475,625 B2 * 10/2016 Di Molfetta ..... B65D 51/00
9,796,508 B1 * 10/2017 Rutherford ..... B65D 59/04
2001/0048198 A1 * 12/2001 Dulin ..... B65D 35/44 277/316
2002/0020718 A1 * 2/2002 Summons ..... B65B 3/14 222/327
2002/0050275 A1 5/2002 Koch
2005/0211734 A1 * 9/2005 Spada ..... B65D 41/0428 222/420
2005/0230439 A1 * 10/2005 McKee ..... B65D 41/0407 222/568
2007/0181573 A1 * 8/2007 Dawson ..... A45C 11/00 220/4.21
2010/0140293 A1 * 6/2010 Dubach ..... B05C 17/005 222/214
2010/0155431 A1 * 6/2010 Bartolucci ..... B05C 17/00583 401/171
2012/0193376 A1 * 8/2012 Evans ..... A47K 5/1215 222/207
2014/0110432 A1 * 4/2014 Hanten ..... B65D 33/1641 222/83
2014/0138386 A1 * 5/2014 Blanchard ..... B65D 39/0029 220/379
2014/0263319 A1 * 9/2014 Fazi ..... B65D 77/0486 220/230
2016/0158776 A1 * 6/2016 Sternberg ..... B65D 23/12 53/431
2018/0044070 A1 * 2/2018 Coe ..... B65D 35/44
2018/0104714 A1 * 4/2018 Coe ..... B65D 77/0486

FOREIGN PATENT DOCUMENTS

EP 1452455 A1 9/2004
JP H0516950 A 1/1993
KR 10-2001-0047398 6/2001
KR 10-2010-0045288 5/2010
KR 10-2010-0045288 A 5/2010
KR 10-20100045288 A 5/2010
KR 20100045288 A 5/2010

OTHER PUBLICATIONS

"Notification Concerning Transmittal of International Preliminary Report on Patentability (Chapter I of the Patent Cooperation Treaty)" for International Patent Application No. PCT/US2017/045250, dated Feb. 21, 2019, 11 pages, The International Bureau of WIPO, Geneva, Switzerland.

(56) References Cited

OTHER PUBLICATIONS

"First Office Action" for Chinese Patent Application No. 201780055782.0, dated Jan. 2, 2020, 6 pages, China National Intellectual Property Administration, Beijing, China.
"Notice of Preliminary Rejection" for Korean Patent Application No. 10-2019-7006963, dated Nov. 6, 2019, 7 pages, Korean Intellectual Property Office, South Korea.
"Notification of Transmittal of the International Search Report and the Written Opinion of the International Searching Authority, or the Declaration" for International Patent Application No. PCT/US2017/045250, dated Oct. 25, 2017, 14 pages, International Searching Authority/KR, Korean Intellectual Property Office, Daejeon, Republic of Korea.
"Notification of Transmittal of the International Search Report and the Written Opinion of the International Searching Authority, or the Declaration" for International Patent Application No. PCT/ US2018/065138, dated Apr. 30, 2019, 14 pages, The International Searching Authority/KR, Daejeon, Republic of Korea.
"Search Report" for European Patent Application No. 17840043.8-1016, dated Feb. 24, 2020, 9 pages, European Patent Office, Munich, Germany.

* cited by examiner

STORAGE CONTAINER FOR TUBE VISCOUS CONSTRUCTION MATERIAL

CROSS-REFERENCE TO RELATED APPLICATION

The present application is a continuation of U.S. patent application Ser. No. 15/845,525, filed on Dec. 18, 2017, entitled "Storage Container for Tube Viscous Construction Material", which is a continuation-in-part of U.S. patent application Ser. No. 15/667,883, filed on Aug. 3, 2017, entitled "Storage Container for Caulking Tube", which claims priority to U.S. Provisional Patent Application Ser. No. 62/374,086, filed Aug. 12, 2016, entitled "Storage Container for Caulking Tube". The entire contents of U.S. patent application Ser. Nos. 15/845,525 and 15/667,883; and U.S. Provisional Patent Application Ser. No. 62/374,086 are incorporated herein by reference.

INTRODUCTION

Various types of viscous materials, such as caulking material, sealants, and adhesive materials are commonly sold in standard cylindrical cartridges. These types of viscous materials are referred to herein as viscous construction materials. These standard cylindrical cartridges have a substantially rigid outer shell with a nozzle at one end that dispenses the viscous construction material. A moveable member or plunger device is typically located at the other end opposite to the nozzle. When the moveable member or plunger device is translated toward the nozzle, pressure builds up inside the cylindrical cartridge that forces the viscous construction material out of the nozzle.

Caulking guns comprise a class of construction and repair tools that expel caulk, sealant or other fill material referred to herein as construction materials from these standard cylindrical cartridges for the purpose of sealing and waterproofing joints that are likely to crack if filled with a rigid, non-flexible material. For example, during caulking, a bead of caulk is extruded from the caulking gun onto the desired location. Soon after the caulk has been applied, the user generally smooths and shapes the caulk with either his or her finger or one or more shaping tools. The nozzle is typically shaped to provide a suitable volume and dimension of material on the desired surface.

Numerous types of caulking guns have been developed over many decades that hold the cylindrical cartridges in place so that an actuator can actuate the moveable member or plunger device to cause a pressure build-up in the cylindrical tube that is sufficient to dispense the viscous materials out of the nozzle on demand. The first type of caulking gun is a bulk dispensing gun which is a complete unit unto itself, containing a closed cylindrical chamber or shell with nozzle and actuating means. For example, U.S. Pat. No. 2,587,683 to Barry discloses a disposable-type caulking gun that includes a tubular container that is adapted to carry an ejection key and a nozzle. The ejection key is threaded into the back of the container and is used to drive an internal plunger to expel the viscous material through the nozzle at one end of the cylindrical container.

The second type of caulking gun is one that has an open framed supporting structure with an actuating mechanism that is designed to be used with a separate cartridge that has its own nozzle and a moveable member or plunger device that cause a pressure build-up in the cylindrical tube that is sufficient to dispense the viscous materials on demand. This, more modern type of caulking gun, is designed to be used with a standard disposable cartridge. The use of disposable cartridge for dispensing many types of viscous fluids is now very common. There are many hundreds of different types of disposable cartridges in an industry standard form factor that are commonly available today for dispensing numerous types of viscous construction materials. Many hardware stores have entire or nearly entire aisles filled with such disposable cartridges of viscous construction materials.

A more modern caulking gun that embodies this second type of caulking gun with an open framed supporting structure and an actuating mechanism that is used with a separate disposable cartridge is disclosed in U.S. Pat. No. 5,137,184 to Jackson et al. The Jackson caulking gun includes an open framework that has a forwardly disposed rim member and a rearwardly disposed trigger actuating mechanism operative on a piston. Some caulking gun with open framed supporting structure use racketing-type actuating mechanism.

A nozzle is removably mounted on the top rim of the gun and is also operatively connectable to a disposable cartridge which is inserted into the gun and cooperative with a piston to dispense caulking or other viscous construction materials through the nozzle. The nozzle has a cone-shaped configuration whose base is of the same dimension as the cartridge. In more recent caulking guns with disposable cartridges, the nozzle is integrated directly into the disposable cartridge.

BRIEF DESCRIPTION OF THE DRAWINGS

The present teaching, in accordance with preferred and exemplary embodiments, together with further advantages thereof, is more particularly described in the following detailed description, taken in conjunction with the accompanying drawings. The skilled person in the art will understand that the drawings, described below, are for illustration purposes only. The drawings are not necessarily to scale, emphasis instead generally being placed upon illustrating principles of the teaching. The drawings are not intended to limit the scope of the Applicant's teaching in any way.

DESCRIPTION OF VARIOUS EMBODIMENTS

Figure 1A:
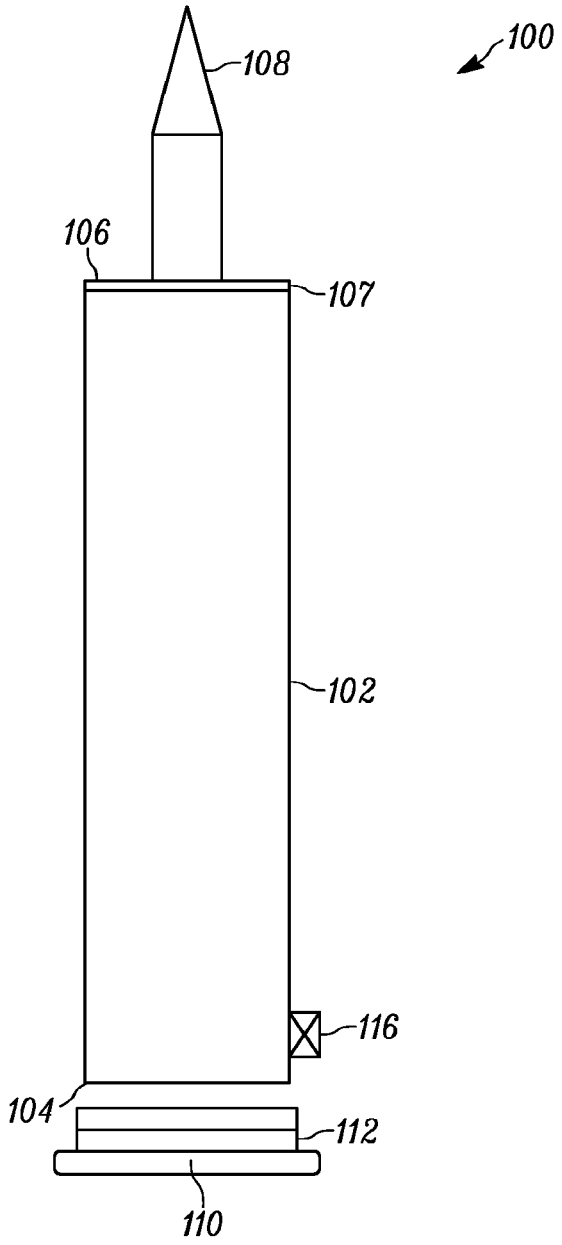
FIG. 1A illustrates a front-view of one embodiment of a single-body storage container for a standard cylindrical tube of viscous construction material according to the present teaching.

The present teaching will now be described in more detail with reference to exemplary embodiments thereof as shown in the accompanying drawings. While the present teachings are described in conjunction with various embodiments and examples, it is not intended that the present teachings be limited to such embodiments. On the contrary, the present teachings encompass various alternatives, modifications and equivalents, as will be appreciated by those of skill in the art. Those of ordinary skill in the art having access to the teaching herein will recognize additional implementations, modifications, and embodiments, as well as other fields of use, which are within the scope of the present disclosure as described herein.

Reference in the specification to "one embodiment" or "an embodiment" means that a particular feature, structure, or characteristic described in connection with the embodiment is included in at least one embodiment of the teaching. The appearances of the phrase "in one embodiment" in various places in the specification are not necessarily all referring to the same embodiment.

It should be understood that the individual steps of the methods of the present teachings can be performed in any order and/or simultaneously as long as the teaching remains operable. Furthermore, it should be understood that the apparatus and methods of the present teachings can include any number or all of the described embodiments as long as the teaching remains operable.

Many industry standard cylindrical disposable cartridges come with a nozzle cover that fits over the nozzle after the use for storage. Such nozzle covers are intended to prevent the viscous construction material from being exposed to air. It is well known that exposing viscous construction material to air will cause solvents in the viscous construction material to evaporate thus reducing the percentage of solvents in the viscous construction material.

Reducing the percentage of solvents in the viscous construction material will increase the viscosity of the viscous construction material. An increase in viscosity increases the resistance to flow of the viscous construction material, thereby making it more difficult to expel the viscous construction material from the nozzle. Increasing viscosity also makes it more difficult to work with the viscous construction material in many construction applications. Eventually, the viscosity of the viscous construction material reaches a level that clogs the nozzle. Even if the nozzle is cleared, the viscous construction material quickly becomes unusable because it cannot be acceptably applied to the work surface.

The time that it takes the viscous construction material to become unusable varies depending on many factors, such as the type of viscous construction material and solvents used in the viscous construction material, the cylindrical tube construction, and the environmental conditions. However, the time that it takes the viscous construction material to become unusable is relatively short and can be a few hours to a few days depending on the various factors. Consequently, the casual user of viscous construction material typically gets only one, or a few, uses out of the standard cylindrical tube. For many applications, this means that a large portion of the viscous construction material in the tube is wasted because a large enough fraction of solvents evaporate before the remaining material is used.

In addition, nozzle covers that come with cylindrical tubes of viscous construction material typically do not provide a good seal. They are notoriously leaky. Consequently, viscous construction materials commonly leak out of the nozzle cover. Since most of the viscous construction materials are sticky materials and sometimes contain toxic materials, this leaking is highly undesirable. Leaked viscous construction materials often destroy clothing and tool bags and leave messy residues in vehicles and workshops that are difficult to clean up. This undesirable leaking can be exacerbated when environmental conditions, such as temperature and pressure, change. For example, leaving a cylinder of viscous construction material in a hot vehicle often exacerbated the leaking and associated damage.

Thus, one significant problem with the industry standard cylindrical disposable cartridges that are widely used today is that, after their first use, they rapidly lose solvents and degrade to the point that they are not usable. For many casual users, the solvent instability results in the product being a single use product where much of the contents of the cylindrical disposable cartridge are discarded.

One aspect of the present teaching is the realization that the nozzle cap provided with many industry standard cylindrical disposable cartridges containing viscous construction materials is not effective in preventing solvent loss after the cartridges are open because most of the solvent loss actually occurs through the moveable member or plunger device that is typically located at the end opposite to the nozzle.

Experiments were performed where the nozzle of the industry standard cylindrical disposable cartridge was cut in a typical manner before use and the moveable member or plunger device was actuated to dispense the product, as a consumer would do. The exterior of the nozzle was then wiped clean and the nozzle cover was placed on the nozzle. The weight loss in the industry standard cylindrical disposable cartridge was then measured after accelerated stability testing at 86 degrees Fahrenheit and at 120 degrees Fahrenheit. The resulting weights were compared to a control sample. All experiments showed significant weight loss due to the loss of solvents from the construction materials. Various experiments also showed that a majority of the solvent loss was through the moveable member or plunger device and not through the nozzle cover.

FIG. 1A illustrates a front-view of one embodiment of a single-body storage container 100 for a standard cylindrical tube of viscous construction material according to the present teaching. In this embodiment, there is a single body 102 that contains the entire standard cylindrical tube of viscous construction material. In some embodiments, the single body 102 is formed from plastic. For example, the single body 102 can be formed of thermoplastic material including at least one of liquid crystalline polymer, polyethylene, polyamide, polycarbonate, polypropylene, polyphenylene sulfide, thermoplastic elastomer, copolyester elastomer, polystyrene, polyvinyl chloride, polytetraflouroethylene, and poly (methyl methacrylate). One skilled in the art will appreciate that numerous types of plastic materials having the desired mechanical and stability properties can also be used. These plastic materials can be embedded with a colorant.

The single body 102 is open at a bottom end 104 to receive a standard cylindrical tube of viscous construction material. In addition, the single body 102 is dimensioned to contain the entire standard tube of viscous construction material so that the standard tube easily fits into the single body 102, while minimizing the volume of open space in the single body 102 that can be occupied by solvents.

The top end 106 of the single body 102 includes a nozzle enclosure 108 that is dimensioned to receive a nozzle of a standard cylindrical tube of viscous construction material. In one embodiment, the nozzle enclosure 108 is formed directly into the top portion of the single body 102. In other embodiments, the nozzle enclosure 108 is removably attached. Removable nozzles can be attached and detached by numerous means such as a screw-type mechanism or one of many types of locking mechanisms.

In some embodiments, an O-ring or gasket 107 is positioned at the top end 106 of the single body 102. This O-ring or gasket 107 seals the nozzle enclosure 108 from the main body 102. Sealing the nozzle enclosure 108 will prevent solvents from escaping into the main body 102. Sealing the nozzle enclosure 108 will also present a minimal volume around the tip of the standard cylindrical tube of viscous construction material, thereby preventing any substantial amount of solvent from escaping through the tip of the cylinder of viscous construction material. Thus, one aspect of the storage container 100 of the present teaching is that it is dimensioned so that the entire standard cylindrical tube of viscous construction material fits completely within the single body 102 when sealed to substantially prevent any caulking or other construction materials from leaking out of the storage container 100.

The storage container 100 also includes a base 110 that seals the bottom end of the single body 102 fully enclosing the standard cylindrical tube of viscous construction material in the single body 102. In some embodiments, the base 110 includes an O-ring or other type of gasket 112 which can be positioned at a top lip to create an air tight seal. Creating an air tight seal around the bottom end 104 of the storage container 100 is important because a large fraction of the solvents escaping from the standard cylindrical tube of viscous construction material escape from the moveable member or plunger device. Thus, one aspect of the storage container 100 of the present teaching is that it is dimensioned to create an air tight seal at the bottom end 104 to substantially prevent any solvents or caulking or other viscous construction materials from leaking out of the storage container 100. In some methods of use, air is injected into the storage container 100 through a valve to create a positive pressure in the storage container 100 that fills the spaces in the storage container 100 thereby preventing solvents from escaping the nozzle of the standard cylindrical tube of viscous construction material.

Figure 1B:
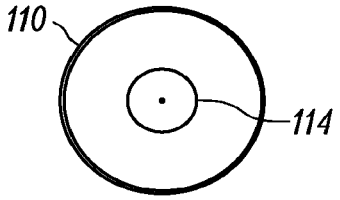
FIG. 1B illustrates a top-view of the base of the single body storage container described in connection with FIG. 1A.

FIG. 1B illustrates a top-view of the base 110 of the single body 102 described in connection with FIG. 1A. In one embodiment, the base 110 includes a valve 114 that allows a pump to inject air between the single body 102 and the standard cylindrical tube of viscous construction material. The valve 114 can be a one-way valve that lets air into the single body 102, but prevents air from leaving the single body 102. In some embodiments, the valve 114 includes a pressure release that equalizes the pressure in the single body 102 with its environment to assist in removing the base 110. In other embodiments, the single body 102 includes a separate pressure release valve 116. The pump can also be used to evacuate air and solvents between the single body 102 and the standard cylindrical tube of viscous construction material. The valve 114 can also be a one-way valve that allows air to be removed from the single body 102, but prevents air from going into the single body 102.

Figure 2A:
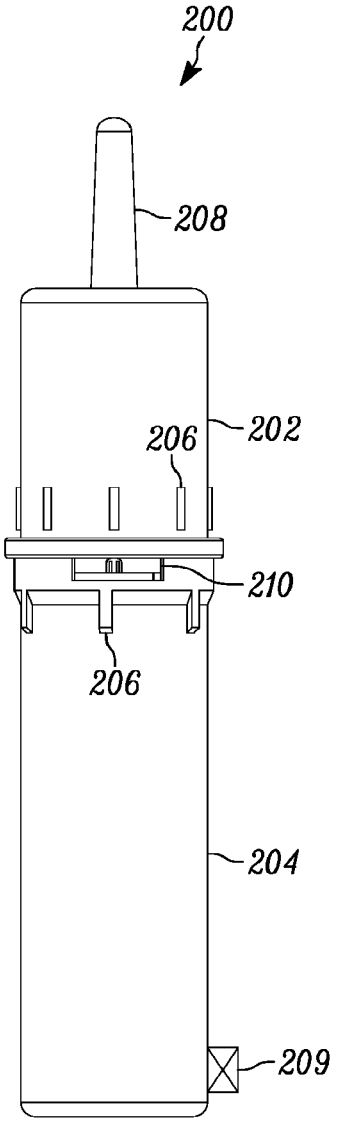
FIG. 2A illustrates a front-view of one embodiment of a segmented-body storage container for a standard cylindrical tube of viscous construction material according to the present teaching.
Figure 2B:
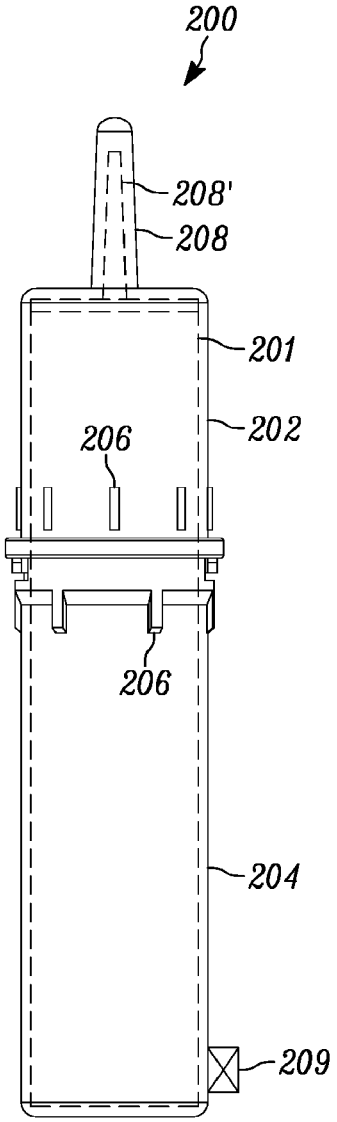
FIG. 2B illustrates a back-view of one embodiment of a segmented-body storage container for a standard cylindrical tube of viscous construction material according to the present teaching.

FIG. 2A illustrates a front-view of one embodiment of a segmented-body storage container 200 for a standard cylindrical tube of viscous construction material according to the present teaching. FIG. 2B illustrates a back-view of one embodiment of a segmented-body storage container 200 for a standard cylindrical tube of viscous construction material 201 according to the present teaching. Referring to both FIGS. 2A and 2B, the segmented-body storage container 200 comprises a two-segment container having an upper segment 202 and a lower segment 204 that are designed to surround the standard cylindrical tube of viscous construction material 201. In some embodiments, the upper segment 202 and the lower segment 204 can include protrusions 206 that assist in gripping the respective segments 202 and 204 so as to assist in assembling the segmented-body storage container 200. The protrusions 206 can be designed to be strong enough so that a tool can be used on them to rotate them to engage and disengage the upper and lower segments 202, 204 if necessary. The upper segment 202 includes the nozzle enclosure 208. As described in connection with FIG. 1, the nozzle enclosure 208 is dimensioned to receive a nozzle of a standard cylindrical tube of viscous construction material 201. The front-view of the segmented-body storage container 200 also shows a coupling mechanism 210 that is described in FIG. 2D. As described in connection with FIGS. 1A and 1B, the segmented-body storage container 200 can be formed of various types of plastic materials. In some embodiments, at least one of the upper and lower segments 202, 204 includes a valve 209 that can be used for at least one of injecting air into the segmented-body storage container 200, evacuating air from the segmented-body storage container 200, and/or equalizing the pressure inside the segmented-body storage container 200 with the environment.

Figure 2C:
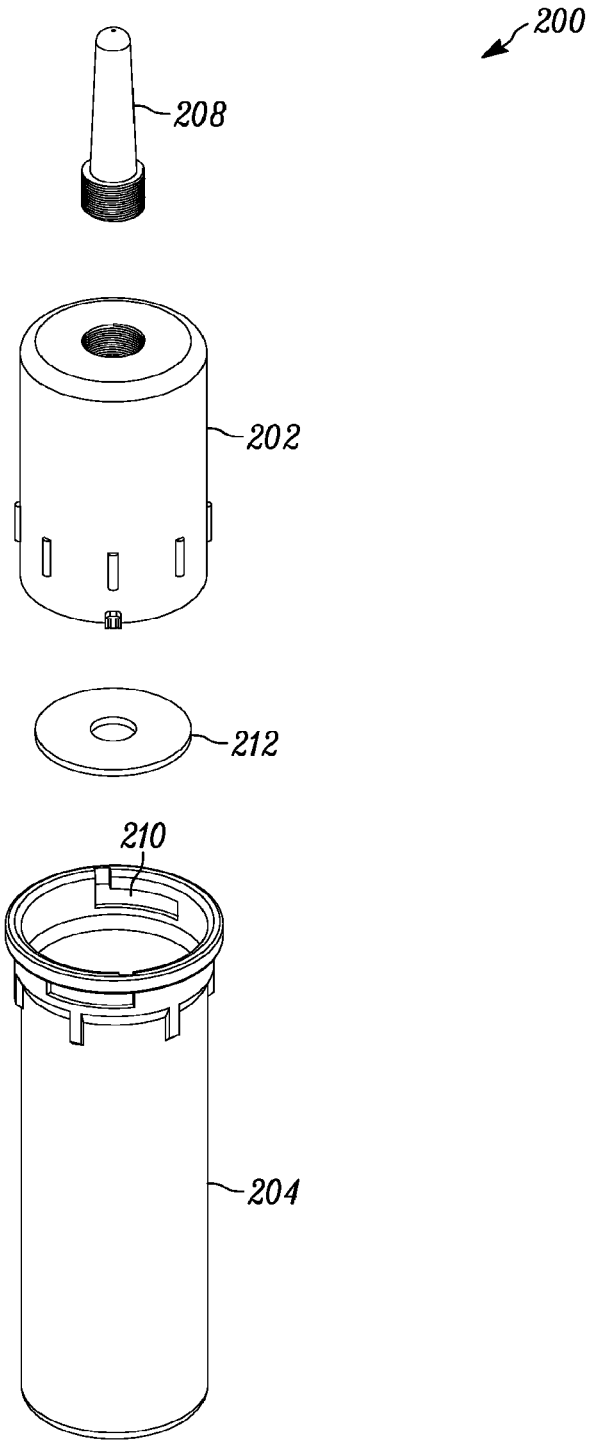
FIG. 2C illustrates an exploded-view of the segmented-body storage container for a standard cylindrical tube of viscous construction material described in connection with FIGS. 2A and 2B.

FIG. 2C illustrates an exploded-view of the segmented-body storage container 200 for a standard cylindrical tube of viscous construction material described in connection with FIGS. 2A and 2B. The exploded-view shows the upper segment 202 and the lower segment 204 separated. The nozzle enclosure 208 is shown as being removably attached and separate from the upper segment 202. In the embodiment shown, the nozzle enclosure 208 screws into the upper segment 202. However, it should be understood that the nozzle enclosure 208 can be removably attached to the upper segment 202 by numerous other fastening, attaching, and locking means. Also, in other embodiments, the nozzle enclosure 208 is formed directly into the top of the upper segment 202. In some embodiments, an O-ring or gasket 212 is positioned at the top of the upper segment 202. This O-ring or gasket 212 seals the nozzle enclosure 208 from the upper and lower segments 202, 204 thereby preventing solvents from escaping from the nozzle enclosure 208. The storage container 200 also includes the coupling mechanism 210 that couples the upper and lower segments 202, 204. Numerous types of coupling mechanisms can be used.

Figure 2D:
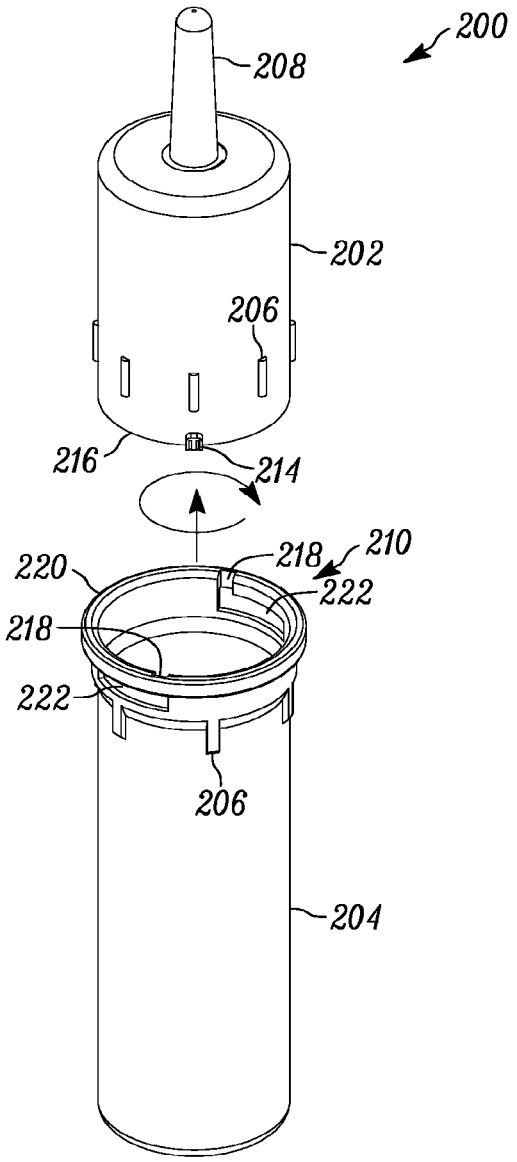
FIG. 2D illustrates one embodiment of a coupling mechanism of the segmented-body storage container for a standard cylindrical tube of viscous construction material described in connection with FIGS. 2A and 2B.

FIG. 2D illustrates one embodiment of a coupling mechanism 210 of the segmented-body storage container 200 for a standard cylindrical tube of viscous construction material described in connection with FIG. 2A. The coupling mechanism 210 comprises a pair of vertical key protrusions 214 positioned opposite to each other on the bottom lip 216 of the upper segment 202. The vertical key protrusions 214 are dimensioned to extend into a pair of vertical slots 218 on the top surface 220 of the lower segment 204. The lower segment 204 includes a pair of horizontal slots 222 extending from the vertical slots 218 on the top surface 220 of the lower segment 204 an angular distance. The pair of horizontal slots 222 is positioned proximate to the top surface 220 of the lower segment 204.

During assembly, the vertical key protrusions 214 in the upper segment 202 are positioned into the vertical slots 218 on the top surface 220 of the lower segment 204. When the vertical protrusions 214 in the upper segment 202 reach the horizontal slots 222 in the lower segment 204, the user rotates at least one of the upper and lower segments 202, 204 so that the vertical key protrusions 214 in the upper segment 202 move into the horizontal slots 222 in the lower segment 204, thereby securing the upper segment 202 to the lower segment 204 of the segmented-body storage container 200.

Figure 2E:
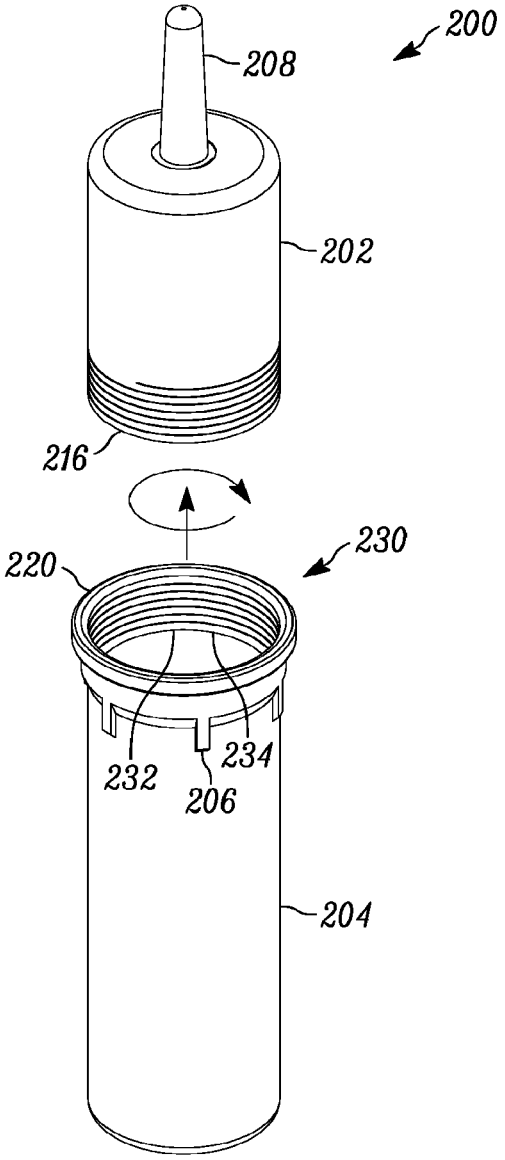
FIG. 2E illustrates another embodiment of a coupling mechanism of the segmented-body storage container for a standard cylindrical tube of viscous construction material described in connection with FIGS. 2A and 2B.

FIG. 2E illustrates another embodiment of a coupling mechanism 230 of the segmented-body storage container 200 for a standard cylindrical tube of viscous construction material described in connection with FIGS. 2A and 2B. The coupling mechanism 230 is a threaded coupling mechanism that comprises a screw mechanism with mating screw threads for the upper segment 202 and the lower segment 204. Screw threads are very well known in the art. Screw threads are helical structures used to convert between rotational and linear movement or force.

The helix of a thread can twist in two possible directions, which is known in the art as handedness. In the embodiment shown in FIG. 2E, the thread is right handed. However, one skilled in the art will appreciate that the threaded coupling mechanism used to attach the upper and lower segments 202, 204 can include left-handed or right-handed threads. The threaded coupling mechanism shown in FIG. 2E includes a right-hand externally threaded upper segment 202 that mates with a right-hand internally threaded lower segment 204. However, one skilled in the art will appreciate that the upper segment 202 can be internally threaded and the lower segment 204 can be externally threaded in other embodiments.

In some embodiments, a gasket 232, such as an O-ring gasket, is positioned in a groove 234 in the internally threaded lower segment 204. The gasket 232 substantially prevents vapors and viscous material from being passed to an outer surface of the storage container.

During assembly, the externally threaded upper segment 202 is threaded into the internally threaded lower segment 204 by hand. In embodiments that include the gasket 232, the externally threaded upper segment 202 is threaded into the internally threaded lower segment 204 until the gasket 232 is sufficiently compressed to form an air-tight seal.

One skilled in the art will appreciate that numerous other coupling means can be used to couple the upper segment 202 to the lower segment 204 when the cylindrical tube of viscous construction material is positioned inside the segmented-body storage container 200.

Figure 3A:
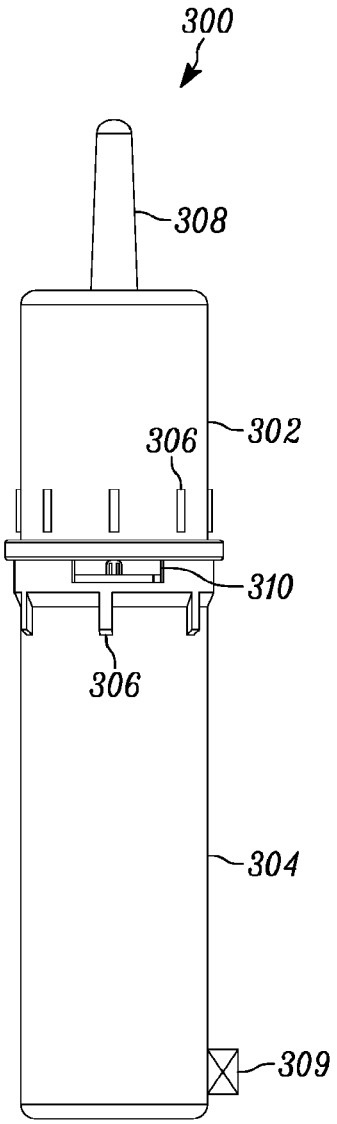
FIG. 3A illustrates a front-view of another embodiment of a segmented-body storage container for a standard cylindrical tube of viscous construction material according to the present teaching.
Figure 3B:
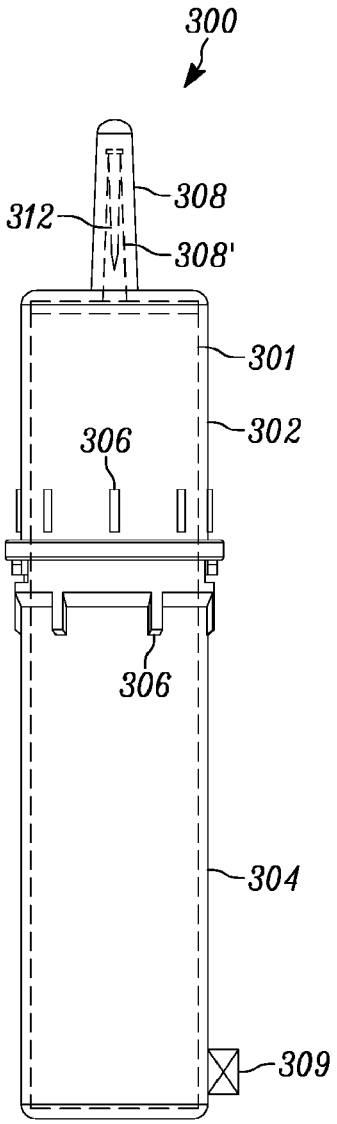
FIG. 3B illustrates a back-view of one embodiment of a segmented-body storage container for a standard cylindrical tube of viscous construction material according to the present teaching.

FIG. 3A illustrates a front-view of another embodiment of a segmented-body storage container 300 for a standard cylindrical tube of viscous construction material according to the present teaching. FIG. 3B illustrates a back-view of one embodiment of a segmented-body storage container 200 for a standard cylindrical tube of viscous construction material according to the present teaching. The embodiment of the segmented-body storage container 300 is similar to the embodiment of the segmented-body storage container 300 that was described in connection with FIGS. 2A-2E except for the nozzle enclosure. Referring to both FIGS. 3A and 3B, the segmented-body storage container 300 comprises a two-segment container having an upper segment 302 and a lower segment 304. In some embodiments, the upper segment 302 and the lower segment 304 can include protrusions 306 that assist in gripping the respective segments 302 and 304 so as to assist in assembling the segmented-body storage container 300. As described in connection with FIGS. 2A and 2B, the protrusions 306 can be designed to be strong enough so that a tool can be used on them to rotate them to engage and disengage the upper and lower segments 302, 304 if necessary.

The upper segment 302 includes the nozzle enclosure 308 that is dimensioned to receive a nozzle 308' of a standard cylindrical tube of viscous construction material. However, the nozzle enclosure 308 in FIG. 3B includes a plug 312 that is dimensioned to fit into the inner diameter of the nozzle 308' of the standard cylindrical tube of viscous construction material. In one embodiment, the plug 312 is removably attached to the nozzle enclosure 308. For example, the plug 312 can screw into the nozzle enclosure 308 so that it can be easily cleaned and/or replaced with a different plug 312 that can be the same or different dimensions to accommodate a different type of tube of viscous construction material.

Also, in one embodiment, the plug 312 is formed in a tapered shape where the diameter of the plug 312 gradually reduced towards the end of the plug 312. Using the plug 312 is advantageous for certain types of viscous construction materials. For example, viscous construction materials that perform polymerization reactions that are initiated by an oxidation-reduction reaction (sometimes called a redox reaction) are particularly sensitive to exposure to oxygen. For these materials, even the nozzle enclosure 208 described in connection with FIGS. 2A-2E can contain too much oxygen for longer term storage.

In one embodiment, the plug 312 is formed of an inert material such as Teflon™ that does not react or form a bond with the viscous construction materials. Some known apparatus for sealing tubes of viscous construction materials for a bond with the viscous construction materials that makes it difficult and, in some cases, impossible to remove the apparatus without rendering the tube useful.

One unexpected result from experiments performed by the inventor was that long term stability of these viscous construction materials, which, for example, perform polymerization reactions that are initiated by an oxidation-reduction reaction, is that long term stability is improved when the size of the plug is smaller than the inner diameter of the opening in the nozzle of the tube of viscous construction materials so that some viscous construction material is displaced forming an airtight seal.

Figure 3C:
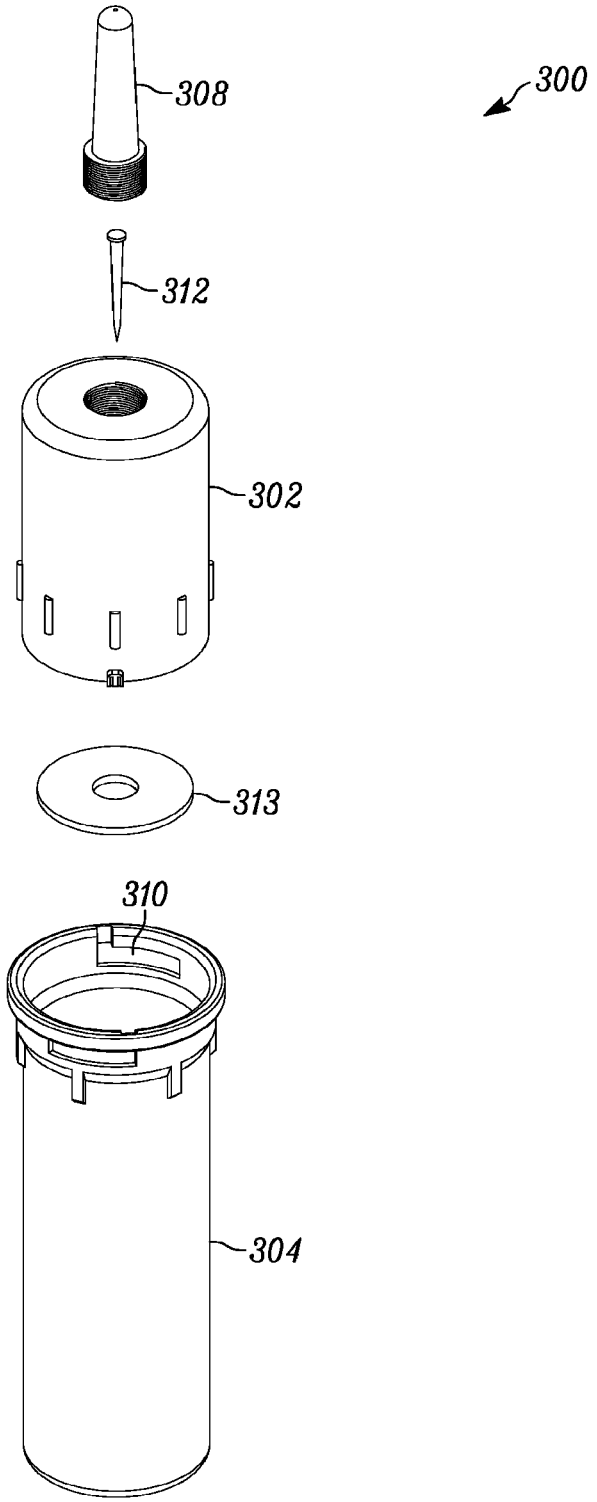
FIG. 3C illustrates an exploded-view of the segmented-body storage container for a standard cylindrical tube of viscous construction material described in connection with FIGS. 3A and 3B.
Figure 3D:
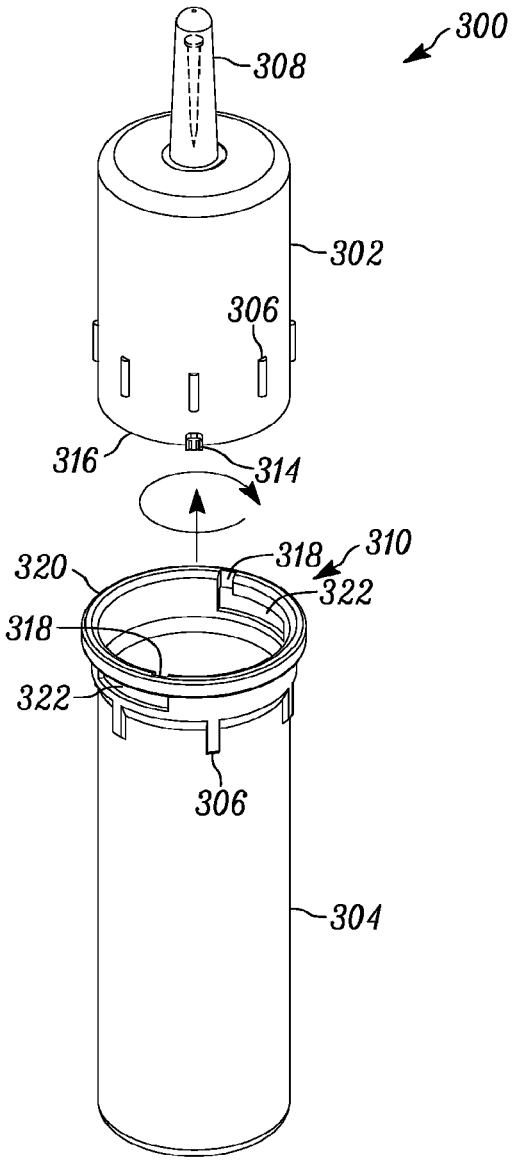
FIG. 3D illustrates an embodiment of a coupling mechanism of the segmented-body storage container for a standard cylindrical tube of viscous construction material described in connection with FIG. 3A.

The front-view of the segmented-body storage container 300 also shows a coupling mechanism 310 that is described in FIG. 3D. As described in connection with FIGS. 1A and 1B, the segmented-body storage container 300 can also be formed of various types of plastic materials. Also, as described in connection with FIGS. 2A and 2B, in some embodiments, at least one of the upper and lower segments 302, 304 includes a valve 309 that can be used for at least one of injecting air into the segmented-body storage container 300, evacuating air from the segmented-body storage container 300, and/or equalizing the pressure inside the segmented-body storage container 300 with the environment.

FIG. 3C illustrates an exploded-view of the segmented-body storage container 300 for a standard cylindrical tube of viscous construction material described in connection with FIGS. 3A and 3B. The exploded-view shows the upper segment 302 and the lower segment 304 separated. The nozzle enclosure 308 that includes the plug 312 is shown as being removably attached and separate from the upper segment 302. In the embodiment shown, the nozzle enclosure 308 screws into the upper segment 302. This allows for easily changing the plug 312 or then entire nozzle closure 308 including the plug 312. It should be understood that the nozzle enclosure 308 can be removably attached to the upper segment 302 by numerous other fastening, attaching, and locking means.

In other embodiments, the nozzle enclosure 308 including the plug 312 is formed directly into the top of the upper segment 302. In some embodiments, an O-ring or gasket 212 is positioned at the top of the upper segment 302. This O-ring or gasket 212 seals the nozzle enclosure 208 from the upper and lower segments 202, 204, thereby preventing solvents from escaping from the nozzle enclosure 308. The storage container 200 also includes the coupling mechanism 310 that couples the upper and lower segments 302, 304. Numerous types of coupling mechanisms can be used.

FIG. 3D illustrates one embodiment of a coupling mechanism 310 of the segmented-body storage container 300 for a standard cylindrical tube of viscous construction material described in connection with FIG. 3A. The coupling mechanism 310 is the same as the coupling mechanism 210 described in connection with FIG. 2D, which comprises a pair of vertical key protrusions 314 positioned opposite to each other on the bottom lip 316 of the upper segment 302. The vertical key protrusions 314 are dimensioned to extend into a pair of vertical slots 318 on the top surface 320 of the lower segment 304. The lower segment 304 includes a pair of horizontal slots 322 extending from the vertical slots 318 on the top surface 320 of the lower segment 304 an angular distance. The pair of horizontal slots 322 is positioned proximate to the top surface 320 of the lower segment 204. The assembly is the same as the assembly described in connection with FIG. 2D.

Figure 3E:
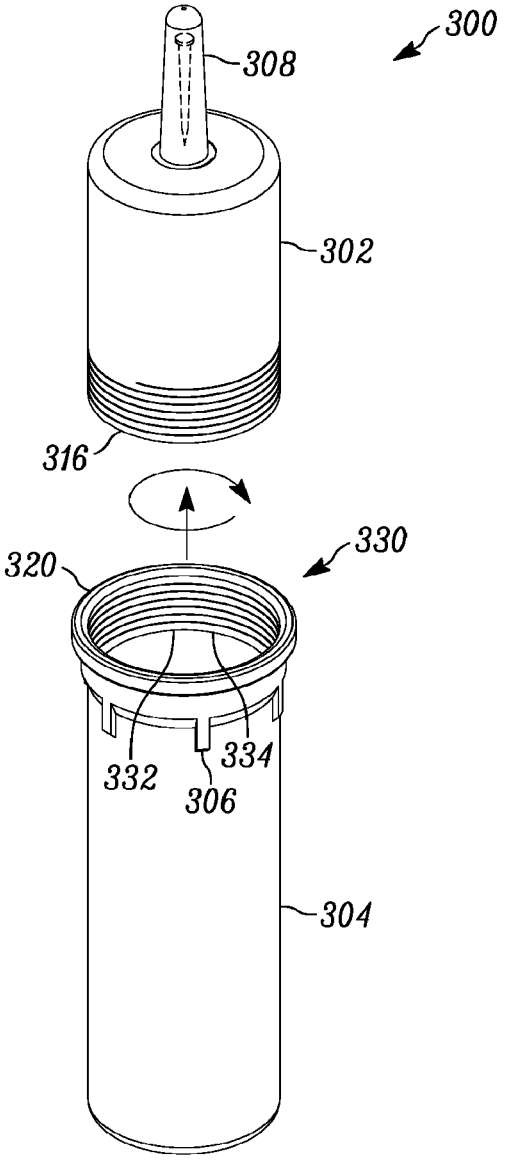
FIG. 3E illustrates another embodiment of a coupling mechanism of the segmented-body storage container for a standard cylindrical tube of viscous construction material described in connection with FIGS. 3A and 3B.

FIG. 3E illustrates another embodiment of a coupling mechanism 330 of the segmented-body storage container 300 for a standard cylindrical tube of viscous construction material described in connection with FIGS. 2A and 2B. The coupling mechanism 330 is similar to the coupling mechanism described in connection with FIG. 2E that includes a threaded coupling mechanism that comprises a screw mechanism with mating screw threads for the upper segment 302 and the lower segment 304. As described in connection with FIG. 2E, the thread is right handed. However, one skilled in the art will appreciate that the threaded coupling mechanism used to attach the upper and lower segments 302, 304 can include left-handed or right-handed threads. The threaded coupling mechanism shown in FIG. 3E includes a right-hand externally threaded upper segment 302 that mates with a right-hand internally threaded lower segment 304. However, one skilled in the art will appreciate that the upper segment 302 can be internally threaded and the lower segment 304 can be externally threaded in other embodiments.

Also, as described in connection with FIG. 2E, in some embodiments, a gasket 332, such as an O-ring gasket, is positioned in a groove 334 in the internally threaded lower segment 304. The gasket 332 substantially prevents vapors and construction material from being passed to an outer surface of the storage container for viscous construction material. The assembly is the same procedure as described in connection with FIG. 2E.

As with the embodiments described in connection with FIG. 2E, one skilled in the art will appreciate that numerous other coupling means can be used to couple the upper segment 302 to the lower segment 304 when the cylindrical tube of viscous construction material is positioned inside the segmented-body storage container 300.

EQUIVALENTS

While the Applicant's teaching is described in conjunction with various embodiments, it is not intended that the Applicant's teaching be limited to such embodiments. On the contrary, the Applicant's teaching encompass various alternatives, modifications, and equivalents, as will be appreciated by those of skill in the art, which may be made therein without departing from the spirit and scope of the teaching.

I claim:

1. A storage container for a cylindrical tube of viscous construction material, the storage container comprising:

a) a body dimensioned to receive the cylindrical tube of viscous construction material;

b) a nozzle enclosure attached to a top end of the body that is dimensioned to receive a nozzle of the cylindrical tube of viscous construction material;

c) a plug positioned in the nozzle enclosure and dimensioned to fit into an inner diameter of the nozzle of the cylindrical tube of viscous construction material;

d) a base that seals the cylindrical tube of viscous construction material in the body; and e) a valve positioned in the body.

2. The storage container of claim 1 wherein the valve comprises a pressure release valve.

3. The storage container of claim 1 wherein the valve is configured to inject air into the body.

4. The storage container of claim 1 wherein the valve is configured to evacuate air from the body.

5. The storage container of claim 1 wherein the valve is configured to equalize pressure inside the body.

6. The storage container of claim 1 wherein the nozzle enclosure is removably attached to a top end of the body.

7. The storage container of claim 1 wherein the nozzle enclosure is removably attached to a top end of the body with a screw mechanism.

8. The storage container of claim 1 wherein the nozzle enclosure is removably attached to a top end of the body with a locking mechanism.

9. The storage container of claim 1 wherein the plug is removably attached to the nozzle enclosure.

10. The storage container of claim 1 wherein the plug is removably attached to the nozzle enclosure with a screw mechanism.

11. The storage container of claim 1 further comprising a gasket positioned between the body and the nozzle enclosure that prevents solvents in the nozzle enclosure from entering into the body.

12. A storage container for a cylindrical tube of viscous construction material, the storage container comprising:

a) a lower body segment that is dimensioned to receive a lower portion of the cylindrical tube of viscous construction material;

b) a valve in the lower body segment;

c) an upper body segment that is dimensioned to receive an upper portion of the cylindrical tube of viscous construction material;

d) a nozzle enclosure that is attached to a top end of the upper body segment that is dimensioned to receive a nozzle of the cylindrical tube of viscous construction material;

e) a plug positioned in the nozzle enclosure and dimensioned to fit into an inner diameter of the nozzle of the cylindrical tube of viscous construction material; and f) a coupling mechanism that attaches the lower body segment to the upper body segment.

13. The storage container of claim 12 wherein the valve comprises a pressure release valve.

14. The storage container of claim 12 wherein the valve is configured to inject air into the body.

15. The storage container of claim 12 wherein the valve is configured to evacuate air from the body.

16. The storage container of claim 12 wherein the valve is configured to equalize pressure inside the body.

17. The storage container of claim 12 wherein the nozzle enclosure is removably attached to the top end of the upper body segment.

18. The storage container of claim 12 wherein the plug is removably attached to the nozzle enclosure.

19. The storage container of claim 12 wherein the plug is removably attached to the nozzle with a screw mechanism.

20. The storage container of claim 12 further comprising a gasket positioned between the upper body segment and the nozzle enclosure that prevents solvents in the nozzle enclosure from entering into the upper and lower body segments.

21. The storage container of claim 12 wherein the coupling mechanism that attaches the lower body segment to the upper body segment comprises:

a) a pair of vertical key protrusions positioned opposite to each other on a bottom lip of the upper body segment;

b) a pair of vertical slots on a top surface of the lower segment dimensioned to receive the vertical key protrusions; and c) a pair of horizontal slots extending from the pair of vertical slots on the top surface of the lower section an angular distance proximate to the top surface of the lower body segment.

22. A storage container for a cylindrical tube of viscous construction material, the storage container comprising:

a) a lower body segment that is dimensioned to receive a lower portion of the cylindrical tube of viscous construction material;

b) an upper body segment that is dimensioned to receive an upper portion of the cylindrical tube of viscous construction material;

c) a valve positioned in the upper body segment;

d) a nozzle enclosure that is attached to a top end of the upper body segment that is dimensioned to receive a nozzle of the cylindrical tube of viscous construction material;

e) a plug positioned in the nozzle enclosure and dimensioned to fit into an inner diameter of the nozzle of the cylindrical tube of viscous construction material; and f) a coupling mechanism that attaches the lower body segment to the upper body segment.

* * * * *